United States Patent [19]

Coeling

[11] 4,423,840

[45] Jan. 3, 1984

[54] ROTARY ATOMIZER BELL

[75] Inventor: Kenneth J. Coeling, Toledo, Ohio

[73] Assignee: Champion Spark Plug Company, Toledo, Ohio

[21] Appl. No.: 241,620

[22] Filed: Mar. 9, 1981

[51] Int. Cl.[3] ..... B05B 5/02

[52] U.S. Cl. ..... 239/3; 239/7; 239/224; 239/703

[58] Field of Search ..... 239/3, 7, 700–703, 239/223, 224

[56] References Cited

U.S. PATENT DOCUMENTS

| | | | |
|---|---|---|---|
| 1,360,654 | 11/1920 | Littlefield | 239/703 |
| 2,698,814 | 1/1955 | Ransburg | 117/62 |
| 2,728,607 | 12/1955 | Smart | 299/63 |
| 2,759,763 | 8/1956 | Juvinall | 299/63 |
| 2,784,114 | 3/1957 | Miller | 117/93 |
| 2,809,902 | 10/1957 | Ransburg | 117/93 |
| 2,893,894 | 7/1959 | Ransburg | 117/93 |
| 2,901,178 | 8/1959 | Norris | 239/15 |
| 2,922,584 | 1/1960 | Slatkin | 239/245 |
| 2,926,106 | 2/1960 | Gauthier | 117/93 |
| 2,980,337 | 4/1961 | Kozinski | 239/15 |
| 2,989,241 | 6/1961 | Badger | 239/15 |
| 3,000,574 | 9/1961 | Sedlacsik, Jr. | 239/15 |
| 3,001,719 | 9/1961 | Sigvardsson | 239/15 |
| 3,009,441 | 11/1961 | Juvinall | 118/624 |
| 3,010,428 | 11/1961 | Sedlacsik | 118/626 |
| 3,021,077 | 2/1962 | Gauthier | 239/15 |
| 3,043,521 | 7/1962 | Wampler | 239/223 |
| 3,048,498 | 8/1962 | Juvinall et al. | 117/93 |
| 3,051,394 | 8/1962 | Sedlacsik, Jr. | 239/3 |
| 3,055,592 | 9/1962 | Probst | 239/15 |
| 3,083,911 | 4/1963 | Griffiths, Jr. | 239/223 |
| 3,085,749 | 4/1963 | Schweitzer et al. | 239/15 |
| 3,113,037 | 12/1963 | Watanabe | 117/93.4 |
| 3,121,533 | 2/1964 | Sedlacsik, Jr. | 239/15 |
| 3,128,045 | 4/1964 | Gauthier | 239/15 |
| 3,128,201 | 4/1964 | Gauthier | 117/93.42 |
| 3,130,066 | 4/1964 | Brady | 117/93.43 |
| 3,147,146 | 9/1964 | Sedlacsik, Jr. | 118/627 |
| 3,148,831 | 9/1964 | Point | 239/15 |
| 3,148,832 | 9/1964 | Point | 239/15 |
| 3,155,539 | 11/1964 | Juvinall | 118/11 |
| 3,178,114 | 4/1965 | Point | 239/15 |
| 3,221,992 | 12/1965 | Sedlacsik, Jr. et al. | 239/15 |
| 3,281,076 | 10/1966 | Burnside et al. | 239/7 |
| 3,290,169 | 12/1966 | Sedlacsik, Jr. | 117/93.41 |
| 3,357,640 | 12/1967 | Grossteinbeck et al. | 239/15 |
| 3,377,987 | 4/1968 | Juvinall et al. | 118/626 |
| 3,384,050 | 5/1968 | Point | 118/626 |
| 3,442,688 | 5/1969 | Pettigrew | 117/93.4 |
| 3,504,851 | 4/1970 | Demeter | 239/15 |
| 3,512,502 | 5/1970 | Drum | 118/624 |
| 3,556,400 | 1/1971 | Gebhardt et al. | 239/15 |
| 3,684,174 | 8/1972 | Bein | 239/15 |
| 3,826,425 | 7/1974 | Scharfenberger et al. | 239/15 |
| 3,900,000 | 8/1975 | Gallen | 118/630 |
| 4,037,561 | 7/1977 | LaFave et al. | 118/629 |
| 4,114,564 | 9/1978 | Probst | 118/626 |
| 4,148,932 | 4/1979 | Tada et al. | 427/31 |
| 4,171,100 | 10/1979 | Benedek et al. | 239/700 |
| 4,214,708 | 7/1980 | Lacchia | 239/703 |

FOREIGN PATENT DOCUMENTS

| | | | |
|---|---|---|---|
| 2659428 | 7/1978 | Fed. Rep. of Germany | 239/700 |
| 1438510 | 3/1965 | France | 239/703 |
| 2041248A | 9/1980 | United Kingdom . | |

OTHER PUBLICATIONS

Tholme, Roger and Sorcinelli, Gene. *Breakthrough in Automatic Painting,* Industrial Finishing, Nov. 1977.

*Primary Examiner*—Andres Kashnikow
*Assistant Examiner*—Michael J. Forman
*Attorney, Agent, or Firm*—Emch, Schaffer & Schaub, Co.

[57] ABSTRACT

An improved rotary atomizer bell is disclosed for use in an electrostatic rotary atomizer liquid paint applicator. The bell has a paint discharge edge at a front end and has a predetermined wall thickness at the front end. In one embodiment, a radius of from 0.040 inch up to the front end wall thickness is provided between an exterior surface and a flat front end surface. In a modified embodiment, the front end surface on the bell lies on a right conical surface of revolution having an apex located on the axis of revolution of the bell and spaced outwardly from the bell and having a base angle of between about 7° to 20°.

3 Claims, 3 Drawing Figures

ROTARY ATOMIZER BELL

BACKGROUND OF THE INVENTION

This invention relates to coating with liquids and more particularly to an improved rotary atomizer bell in which liquid paint is electrostatically charged and atomized.

The rotary atomizer is one type of apparatus now used commercially for electrostatic coating with liquid paint. The rotary atomizer coater generally includes an atomizing bell, a motor for rotating the bell at a high speed, a liquid paint supply and a high voltage power source for applying an electrostatic charge to the atomized paint particles relative to an article being coated. In early rotary atomizers, the motor rotated the bell or disk at speeds generally less than 4,000 rpm. Currently, there is a trend towards higher speeds ranging on the order of from 10,000 rpm to 40,000 rpm, or more. The higher speeds permit the effective atomization of liquid paints and coatings which otherwise are extremely difficult to atomize. Also, the higher speeds greatly increase the quantity of paint which can be atomized by a single applicator.

When using an electrostatic rotary atomizer foam or bubbles can sometimes cause defects to appear in the applied coating in the form of either a sand paper appearance, a haze that destroys gloss or a rough surface. The cause of these defects is not known, although many believe it to be the result of "entrapped air" in some of the atomized paint particles which causes these particles to foam. One method for minimizing the defects in the finishes produced through the use of ultra high speed rotary atomizers is disclosed in U.S. Pat. No. 4,148,932. This patent is directed to a rotary atomizer bell having a plurality of shallow grooves near its periphery which extend in a radial direction and increase in depth in the direction of paint flow and terminate in the discharge edge of the bell. Although these grooves are effective in minimizing the entrapped air or other source of defects in the applied coating, the grooves add to the manufacturing costs of the bell. The grooves also result in a fairly fragile edge on the bell. Totally rounding the discharge edge of a bell having a thick wall also has been suggested in published British patent application No. 2,041,248A as a means for reducing or eliminating defects in the applied coating. However, in accordance with the present invention, it has been found unnecessary to totally round the discharge edge to eliminate the problems.

SUMMARY OF THE INVENTION

According to the present invention, an ultra high speed rotary atomizer bell is designed to eliminate foam or bubbles in the applied coating which produces defects in the form of a sand paper appearance, haze or a rough surface. Paint is supplied continuously from a conventional source to a paint receiving chamber in the back of the rotary atomizer bell. As the bell is rotated at high speed, centrifugal force causes the paint to flow through distribution apertures to a generally conical interior flow surface on the discharge side of the bell. Centrifugal force also causes the paint to flow along the conical interior surface in a continuous film to a sharp discharge edge between the conical surface and the front end of the bell. The front end of the bell has a predetermined wall thickness and forms a sharp discharge edge at the interior surface and is rounded at the exterior surface. The front end may have a flat between the sharp discharge edge and the rounded exterior surface or it may go directly into the rounded exterior surface from the sharp discharge edge. The radius of the rounded edge is within the range of 0.040 inch up to the wall thickness at the front end of the bell. By rounding the discharge end on the exterior surface, the entrapped air or other cause of bubbles in the applied coating is eliminated, even though the rotary atomizer bell is operated at extreme speeds which may be on the order of 40,000 rpm, or more. In a modified embodiment of the rotary atomizer bell, a slight bevel or incline is formed on the bell discharge end in place of the rounded exterior edge. In other words, the bell front discharge end lies on a surface of revolution which is generally conical and has an apex on the axis of rotation spaced slightly outwardly from the discharge end. The base angle of the conical surface is within the range of from 7° to 20° to be effective. By providing the beveled front end on the bell, entrapped air or the other cause of bubbles in the applied coating again is eliminated.

Accordingly, it is an object of the invention to provide a low cost means for eliminating bubbles in coatings applied with an electrostatic ultra high speed rotary atomizer.

Another object of the invention is to provide a rotary atomizer bell having a structure adapted to eliminate bubbles in an applied coating which otherwise would occur when the bell is operated at speeds above about 10,000 rpm.

Other objects and advantages of the invention will become apparent from the following detailed description, with reference being made to the accompanying drawings.

DESCRIPTION OF THE PREFERRED EMBODIMENT

Figure 1:
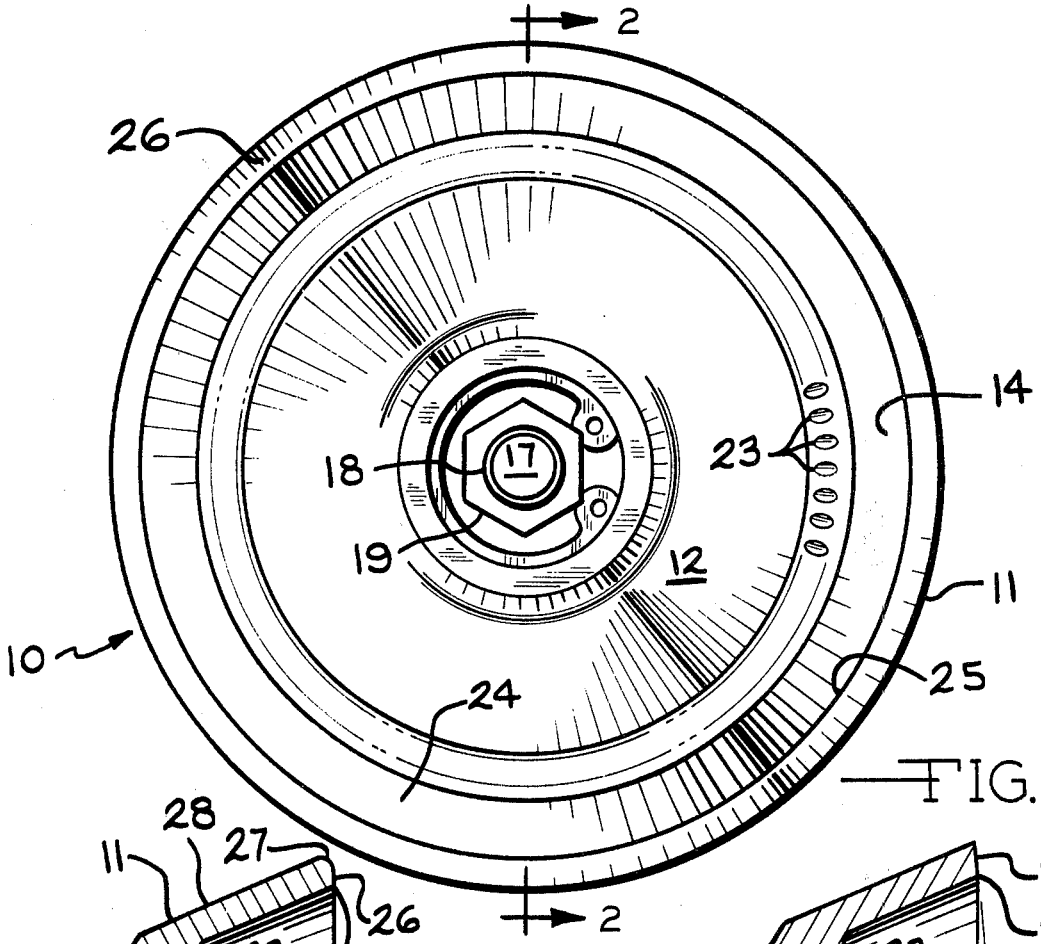
FIG. 1 is a front elevational view of a rotary atomizer bell constructed in accordance with the present invention.
Figure 2:
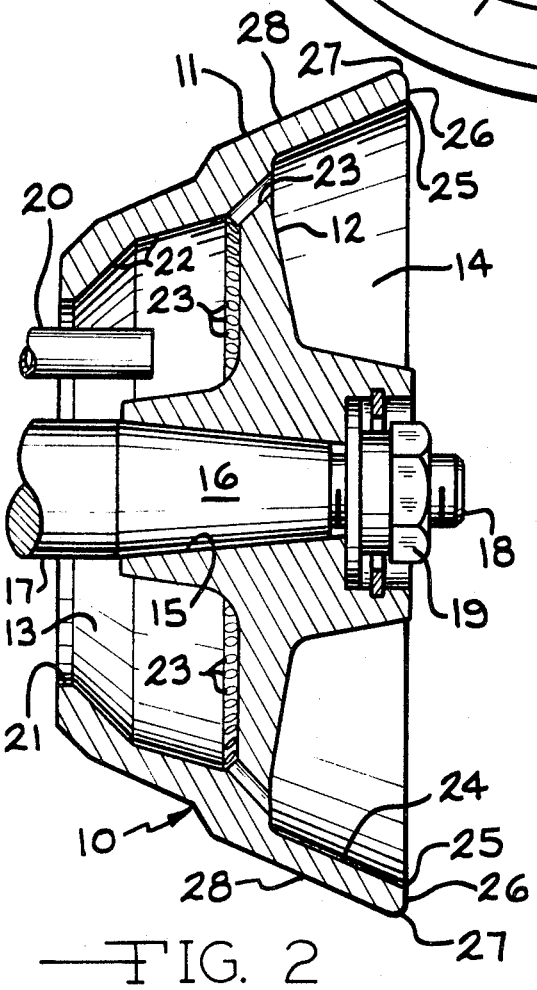
FIG. 2 is a cross-sectional view taken along line 2—2 of FIG. 1.

Turning now to the drawings and particularly to FIGS. 1 and 2, a rotary atomizer bell 10 is shown in accordance with one embodiment of the invention. The rotary atomizer bell is machined from a single block of material which, for example, may comprise an aluminium alloy. The bell 10 generally includes a shell 11 and a central hub 12 which divides the shell 11 into a paint receiving chamber 13 and a paint discharge chamber 14.

The hub 12 defines a tapered central opening 15 which receives a correspondingly tapered end 16 of a drive shaft 17. A clamping nut 19 engages a threaded end 18 on the shaft 17 for retaining the atomizer bell 10 on the shaft 17. The taper on the shaft end 16 and the clamping nut 19 combine to prevent slippage between the shaft 17 and the atomizer bell 10 as the shaft 17 is rotated at a very high speed. The shaft 17 may, for example, comprise the shaft of a high speed air turbine and may be driven at rotational speeds on the order of from 10,000 rpm to 40,000 rpm, or more.

A paint supply tube 20 extends through a rear opening 21 in the bell 10 into the paint receiving chamber 13. The paint receiving chamber 13 has generally conical sides 22 which increase in diameter from the rear opening 21 towards the hub 12. As the paint flows from a conventional paint supply and metering source (not shown) through the tube 20 into the chamber 13, the paint contacting the sides 22 accelerates up to substantially the speed of the rotating bell 10. Centrifugal force acting upon the rotating paint causes the paint to flow along the angled chamber sides 22 towards a plurality of openings 23 spaced around the chamber 13 between the sides 22 and the hub 12. The openings 23 are spaced around the chamber 13 extend through the hub 12 and angle outwardly so that centrifugal force causes the paint to flow from the receiving chamber 13 to the discharge chamber 14. Paint entering the chamber 14 from the openings 23 forms a film which flows radially outwardly along a generally conical interior surface 24 towards a discharge edge 25 between the conical surface 24 and a flat front end 26 on the bell 10.

A high voltage direct current power supply (not shown) is connected between the motor which drives the shaft 17 and the workpieces or articles being coated. Consequently, a high potential is applied through the shaft 17 to the bell 10. As paint enters the bell 10 through the supply tube 20 and flows through the bell 10, such paint becomes electrostatically charged. The charged paint flows along the conical interior surface 24 in the discharge chamber 14 to the discharge edge 25 where it is atomized into very small particles. In accordance with the present invention, it has been found that by providing a radius 27 around the periphery of the shell 11 between the front end 26 and an exterior bell surface 28, bubbles in the applied coating material which have been believed to be caused by "entrapped air" are eliminated. The radius 27 must be at least 0.040 inch to be effective in reducing or eliminating bubbles and may be up to the thickness of the wall of the shell 11 at the front end 26. In other words, if the wall thickness at the front end 26 is 0.100 inch, then the radius 27 must fall within the range of from 0.040 inch to 0.100 inch. Or, if the wall thickness is increased to 0.200 inch then the radius 27 must fall within the range of 0.040 inch to 0.200 inch. Tests have shown that if the radius is below about 0.040 inch, it is ineffective to eliminate bubbles in the applied coating. For example, a radius of 0.030 inch has been totally ineffective while the radius of 0.045 inch or greater was effective to eliminate substantially all of the bubble problem.

Figure 3:
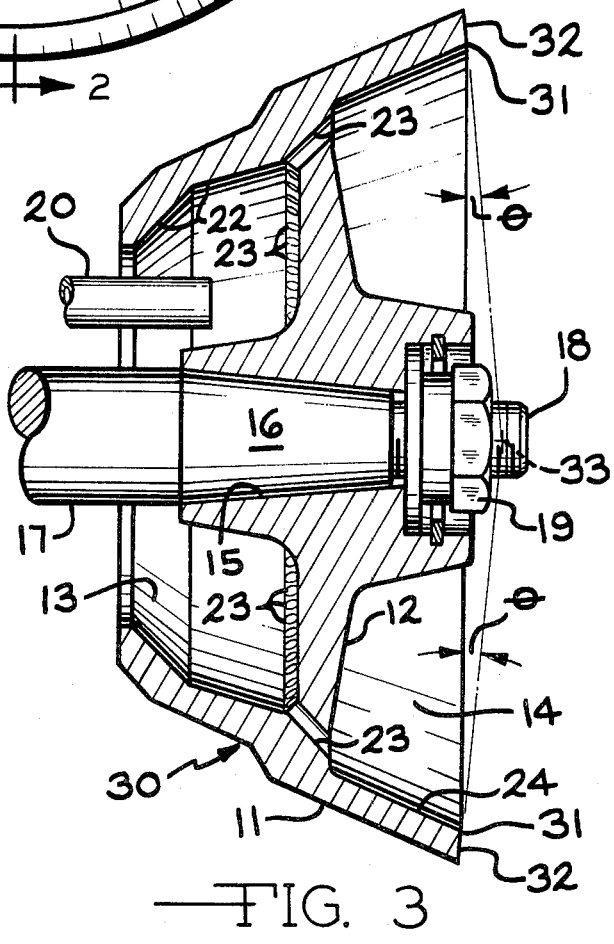
FIG. 3 is a cross-sectional view, similar to that of FIG. 2, and showing a modified embodiment of a rotary atomizer bell constructed in accordance with the present invention.

Turning now to FIG. 3, a cross-sectional view through a modified embodiment of a rotary atomizer bell 30 is illustrated. The bell 30 is similar to the bell 10 and corresponding portions of the bell 30 are labeled with the same reference numbers. The bell 30 generally comprises a shell 11 defining a paint receiving chamber 13 and a paint discharge chamber 14. The chambers 13 and 14 are divided by a hub 12 which mounts the bell 30 on a drive shaft 17. Paint is supplied from a conventional external source (not shown) through a tube 20 to the paint receiving chamber 13 and thence flows through openings 23 in the hub 12 to the paint discharge chamber 14. From the openings 23, the paint flows in a film outwardly along a conical interior surface 24 in the paint discharge chamber 14 to a discharge edge 31 at a front end 32 of the bell 30. The paint flow is caused by centrifugal force resulting from the high rotational speed of the bell 30.

In accordance with the present invention, it has been found that bubbles in the applied paint are substantially eliminated by forming the front bell end 32 at a slight incline or, in other words, in the form of an annular surface which lies on an imaginary cone having an apex 33 located on the axis of the drive shaft 17 ahead of the front shell end 32. The imaginary conical surface on which the front end 32 lies has a base angle $\theta$ lying within the range of from about 7° up to about 20°. For angles below about 7° or above about 20°, the front end 32 of the shell 11 is ineffective to reduce the bubble problems in the applied finish which result in a sand paper appearance, a haze which destroys gloss or a generally rough surface.

It will be appreciated that rounding the outer edge of the front end of the rotary atomizer bell with a radius of at least 0.040 inch or providing the front edge with a slight slope is considerably less expensive than manufacturing the bell with a number of tapered and progressively deeper grooves on the interior flow surface of the bell. It also will be appreciated that various changes and modifications may be made in the rotary atomizer bell without departing from the spirit and scope of the following claims.

What I claim is:

1. In a liquid paint applicator of the type having a high speed motor driven rotary atomizer bell from which electrostatically charged atomized paint particles are discharged, an improved rotary atomizer bell comprising a shell defining a generally conical paint flow surface increasing in diameter from a minimum diameter up to a maximum diameter at a paint discharge edge at a front end of said shell, said shell having an exterior surface, an interior surface, and a predetermined wall thickness at said front end and having a radius of at least 0.040 inch between said exterior surface and said front end, said front end defining a sharp discharge edge at said interior surface and means for supplying a continuous flow of paint to said paint flow surface at a location near such minimum diameter.

2. An improved rotary atomizer bell for a liquid paint applicator, as set forth in claim 1, wherein said radius between said exterior surface and said front end is within the range of from 0.040 inch up to said predetermined wall thickness.

3. An improved method for coating with liquid paint comprising the steps of: rotating a rotary atomizer bell about an axis at a speed of at least 10,000 rpm; applying a high voltage on said bell; supplying a continuous flow of paint to an interior conical flow surface on said bell adjacent a minimum diameter of such flow surface; discharging atomized electrostatically charged paint particles from a paint discharge edge at a flat front end of said bell; providing a sharp discharge edge between said front end and said interior flow surface and providing between an exterior surface of said bell and said front end a radius of from at least 0.040 inch up to the bell wall thickness at said front end.

* * * * *